United States Patent [19]

Satoh

[11] Patent Number: 4,898,415

[45] Date of Patent: Feb. 6, 1990

[54] APPARATUS FOR MOUNTING AN OUTER DOOR HANDLE ASSEMBLY TO AN AUTOMOTIVE DOOR

[75] Inventor: Seiki Satoh, Utsunomiya, Japan

[73] Assignee: Mitsui Kinzoku Kogyo Kabushiki Kaisha, Tokyo, Japan

[21] Appl. No.: 255,582

[22] Filed: Oct. 11, 1988

[30] Foreign Application Priority Data

Oct. 21, 1987 [JP] Japan ..... 62-265939

[51] Int. Cl.[4] ..... E05C 21/00

[52] U.S. Cl. ..... 292/347; 292/DIG. 31; 292/DIG. 53; 292/337

[58] Field of Search ..... 292/113, 247, 336.3, 292/357, 337, DIG. 31, DIG. 53

[56] References Cited

U.S. PATENT DOCUMENTS

| | | | |
|---|---|---|---|
| 2,197,195 | 4/1940 | Schemers | 292/DIG. 31 X |
| 2,929,649 | 3/1960 | Coe | 292/337 X |
| 4,470,624 | 9/1984 | Bisbing | 292/DIG. 38 X |
| 4,693,503 | 9/1987 | Bisbing | 292/DIG. 31 X |
| 4,707,006 | 11/1987 | Garg et al. | 292/DIG. 31 X |

FOREIGN PATENT DOCUMENTS

| | | | |
|---|---|---|---|
| 2627029 | 12/1977 | Fed. Rep. of Germany | 292/DIG. 53 |

*Primary Examiner*—Richard E. Moore

*Attorney, Agent, or Firm*—Browdy and Neimark

[57] ABSTRACT

The apparatus for mounting the outer door handle assembly to the automotive door according to the invention comprises: an outer handle body consisting of an engagement projection, an engagement surface, and a flange; and a mounting fitting consisting of an engagement portion for engagement with the engagement projection, a rotatable engagement claw for engagement with the engagement surface, and a projection edge.

The outer handle body is inserted from outside into the mounting opening in the outer plate of the door; the engagement portion of the mounting fitting is engaged from inside the door with the engagement projection; and the engagement claw is rotated to engage with the engagement surface. As a result the outer plate of the door is tightly clamped by the flange and the projection edge, thus permitting the outer door handle assembly to be securely mounted to the door without the use of bolts and nuts.

4 Claims, 3 Drawing Sheets

APPARATUS FOR MOUNTING AN OUTER DOOR HANDLE ASSEMBLY TO AN AUTOMOTIVE DOOR

FIELD OF THE INVENTION

This invention relates to an apparatus for mounting an outer door handle assembly to the door of automobiles.

PRIOR ART

The conventional method of mounting the outer door handle assembly to the door of a car consists the steps of, as shown in FIG. 6, inserting from outside an outer handle body A into a mounting opening G formed in an external plate D of the automotive door, bringing a flange F into contact with the external plate D, putting a cover plate B over the outer handle body from inside, and fastening the nuts E on the bolts C that project from the handle body A through the cover plate B.

In the known assembly, the mounting takes time as it requires putting the cover plate B over the handle body A and then fastening the nuts E on the bolts C. Furthermore, the nut E may get loose due to vibration so it must be tightened with caution. And if the nut E should get loose, the door has to be disassembled to retighten the assembly.

Object of the Invention

This invention is achieved to provide an apparatus for mounting an outer door handle assembly to the door without the use of bolts and nuts.

DETAILED DESCRIPTION OF THE INVENTION

Figure 4:
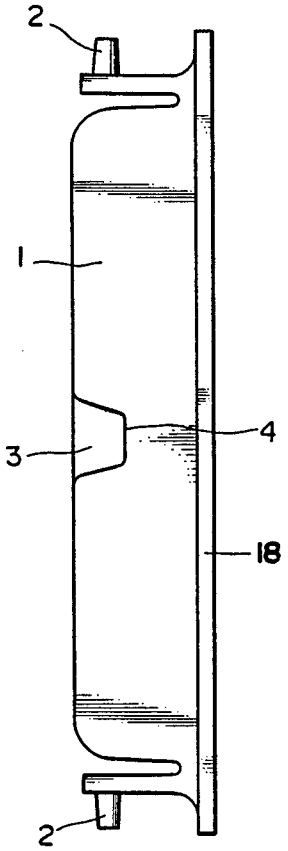
FIG. 4 is a bottom view of the outer handle body.
Figure 5:
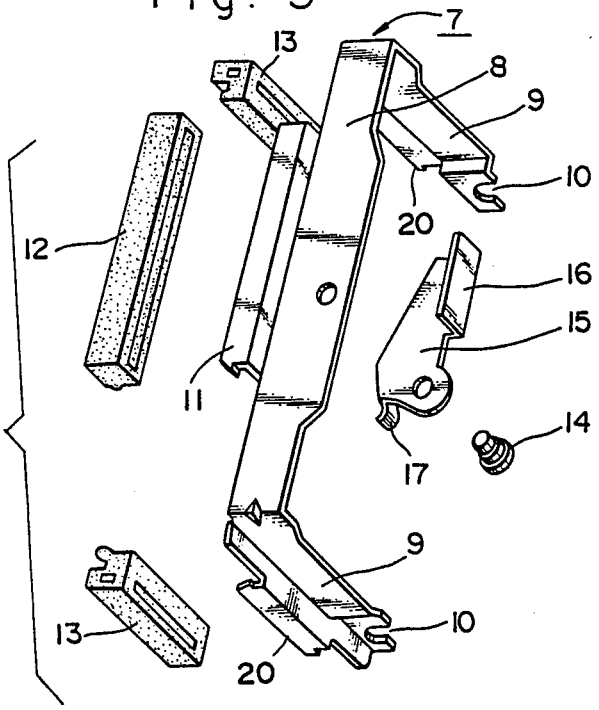
FIG. 5 is an exploded view of the mounting fitting.
Figure 6:
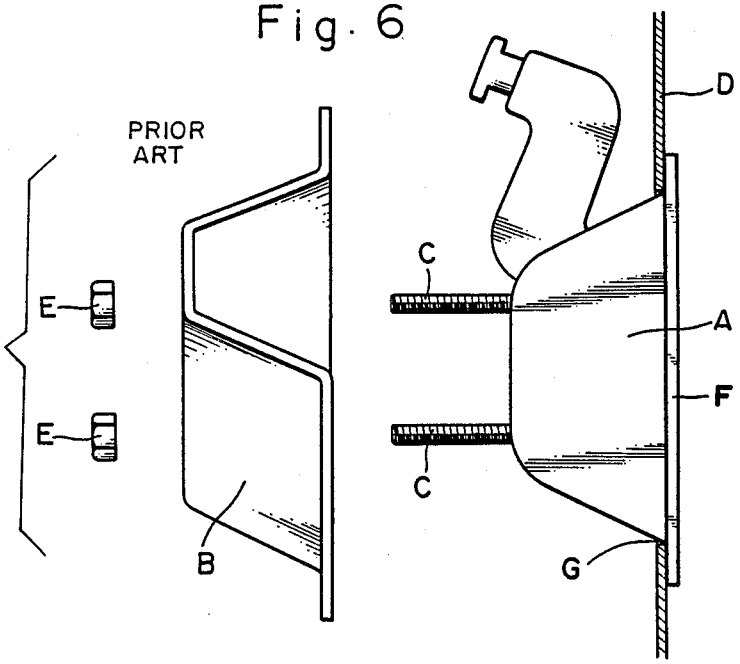
FIG. 6 is a side view of a known outer door handle assembly.

One embodiment of the invention will now be explained by referring to the attached drawings. Reference numeral 1 denotes an outer handle body formed of metal or synthetic resin, which as shown in FIG. 4 has laterally protruding engagement projections 2 one on each side and, at the center bottom, a downwardly projecting portion 3 for engagement. The engagement surface 4 of the projected portion 3 is formed vertical. Denoted 19 is an outer handle mounted to the handle body 1. The front end of the outer handle 19 is connected with a rod or other member (not shown) that leads to a locking device on the door. An outer plate 5 of the door is formed with a mounting opening 6 in which the handle body 1 is inserted.

Designated 7 is a mounting fitting provided inside the outer plate 5 that has a horizontal lateral rod 8 and riser walls 9 extending upwardly and perpendicularly from both ends of the lateral rod 8. At the upper ends the riser walls 9 is provided with a C-shaped engagement portion 10 that engages with the engagement projection

2 provided on each side of the handle body 1. A knob 15 is rotatably mounted, through a shaft 14, on the lateral rod 8 at the inner central part. The knob 15 has an engagement claw 17 that engages with the engagement surface 4 of the projection portion 3, and a stopper 16 that serves also as a manual control. The lateral rod 8 and the riser walls 9 are formed with a projecting edge 11 and projecting edges 20, respectively, that protrude toward the outer plate 5. The projection 11 has a synthetic resin engagement member 12 fitted on it and the projections 20 have synthetic resin engagement members 13 fitted on them. Denoted 18 is a flange of the outer handle body 1.

With the above construction, when the outer handle body 1 is inserted from outside into the mounting opening 6 of the outer plate 5, the flange 18 comes into contact with the outer surface of the outer plate 5.

Figure 1:
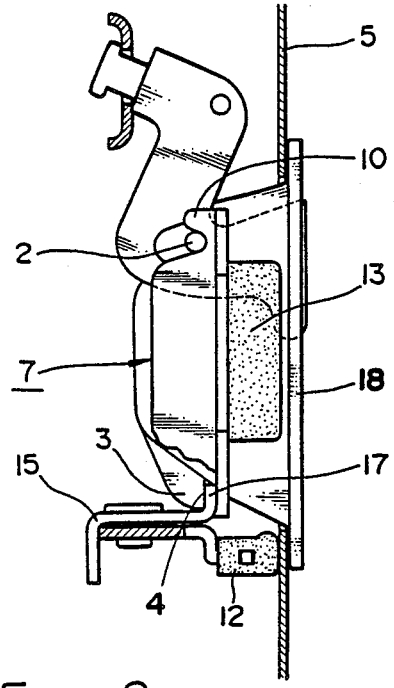
FIG. 1 is a side view, partly cut away, of an embodiment of the invention.
Figure 2:
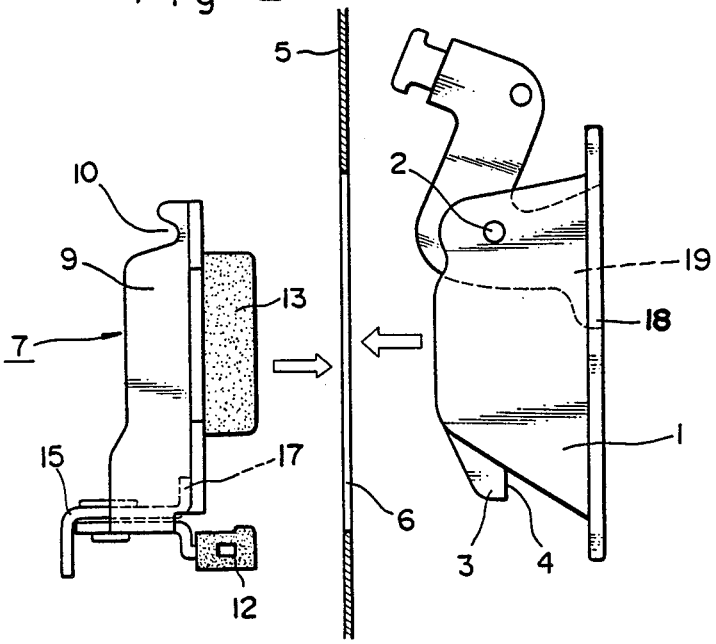
FIG. 2 is a side view of the outer handle body and the mounting fitting disassembled.
Figure 3:
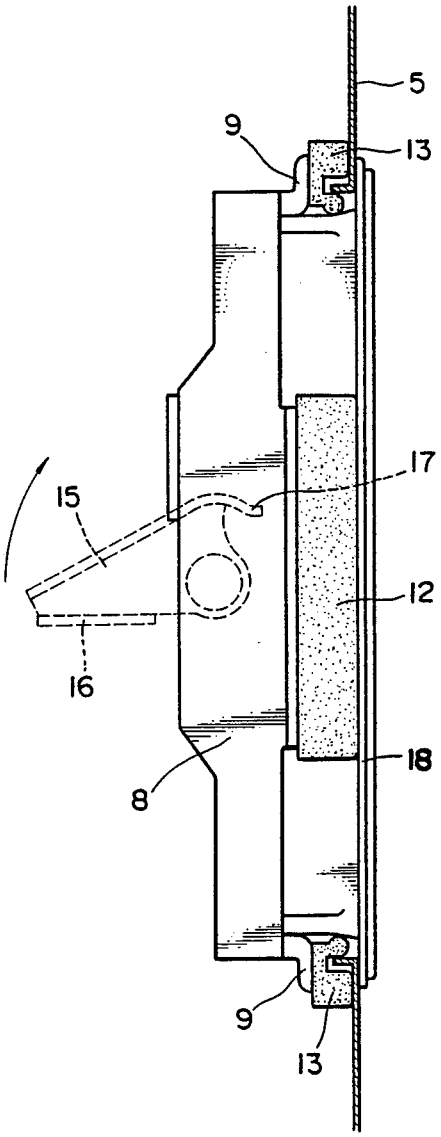
FIG. 3 is a bottom view of the embodiment of the invention.

Then, with the mounting fitting 7 held in one hand, the front ends of the riser walls 9 are inserted between the flange 18 and the engagement projections 2. With the lower portion of the mounting fitting 7 pushed toward the outer plate 5, the engagement portions 10 are brought into engagement with the engagement projections 2. Next, while holding the manual control 16 with finger tips, one turns the knob 15 as shown in FIG. 3, bringing the engagement claw 17 of the knob 15 into engagement with the engagement surface 4 of the projection portion 3, pushing the synthetic resin engagement members 12, 13 toward the outer plate 5. As a result, the outer plate 5 is tightly clamped by the flange 18 and the engagement members 12, 13. Thus, the mounting of the outer handle body 1 to the door is complete.

Advantage

As explained above, this invention permits the outer handle body 1 to be mounted to the door very easily by bringing the engagement portions 10 of the mounting fitting 7 into engagement with the engagement projections 2 of the outer handle body 1 and then turning the knob 15. Furthermore, since no bolts and nuts are used, the outer door handle assembly will not get loose when subjected to vibrations.

I claim:

1. An apparatus for mounting an outer door handle assembly to the automotive door, comprising:

an outer handle body consisting of an outer handle projecting therefrom, an engagement projection adapted to engage a mounting fitting, an engagement surface projecting from said body, and a flange extending at least partly about said body and being adapted to mount against the automobile door; and a said mounting fitting which has an engagement portion for engagement with the engagement projection, an engagement claw for engagement with the engagement surface, and a projection edge;

whereby the outer handle body is inserted from outside into a mounting opening in an outer plate of the door and the mounting fitting is engaged from inside the door with the outer handle body, so that the outer plate of the door is tightly clamped between the flange and the projection edge.

2. An apparatus for mounting an outer door handle assembly to the automotive door, as set forth in claim 1, wherein the engagement claim is rotatably mounted on the mounting fitting.

3. An apparatus for mounting an outer door handle assembly to the automotive door, as set forth in claim 1, wherein the engagement projection is laterally projecting and the engagement portion is shaped like a letter C.

4. An apparatus for mounting an outer door handle assembly to the automotive door, as set forth in claim 1, wherein the projection edge is covered with a resilient engagement member.

* * * * *